US005720222A

United States Patent [19]

Reichardt et al.

[11] Patent Number: 5,720,222

[45] Date of Patent: Feb. 24, 1998

[54] MULTI-MOTOR DRIVE FOR A PRINTING MACHINE

[75] Inventors: Klaus-Peter Reichardt, Bad Vilbel; Joachim Blumoer, Hainburg, both of Germany

[73] Assignee: MAN Roland Druckmaschinen AG, Germany

[21] Appl. No.: 679,716

[22] Filed: Jul. 12, 1996

[30] Foreign Application Priority Data

Jul. 13, 1995 [DE] Germany ..... 195 25 593.3

[51] Int. Cl.[6] ..... B41F 5/00

[52] U.S. Cl. ..... 101/216; 101/183; 101/248

[58] Field of Search ..... 101/181, 183, 101/216, 212, 248, 136, 141, 152, 153, 173, 174, 180

[56] References Cited

U.S. PATENT DOCUMENTS

| | | | |
|---|---|---|---|
| 4,980,623 | 12/1990 | Anton | 318/432 |
| 5,365,841 | 11/1994 | Uhrig | 101/216 |
| 5,481,971 | 1/1996 | Grutzmacher et al. | 101/183 |

FOREIGN PATENT DOCUMENTS

| | | |
|---|---|---|
| 0 355 442 B1 | 7/1989 | European Pat. Off. . |
| 41 37 979 A1 | 5/1993 | Germany . |
| 42 02 722 A1 | 8/1993 | Germany . |
| 42 28 506 A1 | 3/1994 | Germany . |
| 42 34 928 A1 | 4/1994 | Germany . |
| 43 22 744 A1 | 1/1995 | Germany . |
| 2 270 035 | 3/1994 | United Kingdom . |

OTHER PUBLICATIONS

JP 5-318 695 A in Patent Abstracts of Japan, M-1571 Mar. 4, 1994, vol. 18/No. 133.

*Primary Examiner*—Christopher A. Bennett
*Attorney, Agent, or Firm*—Leydig, Voit & Mayer, Ltd.

[57] ABSTRACT

A multi-motor drive for a printing machine includes a static drive and a highly-dynamic drive for providing angle-synchronous driving of the cylinders comprising the printing machine. The static drive imparts a torque to a cylinder to which it is coupled sufficient to rotate the cylinder. The highly-dynamic drive is coupled to the same cylinder and imparts a torque sufficient to compensate for loading moments experienced by the cylinder during rotation. A position encoder is utilized to provide synchronizing signals.

8 Claims, 2 Drawing Sheets

MULTI-MOTOR DRIVE FOR A PRINTING MACHINE

BACKGROUND OF THE INVENTION

1. Field of the Invention

The present invention relates to a multi-motor drive for a printing machine, and more particularly, to a multi-motor drive for individually and angle synchronously driving one or more components in a printing machine.

2. Discussion of the Related Art

Conventional sheet-fed offset printing machines are, as a rule, driven by a direct-current motor via a continuous gear train. Particularly because of the individual channel rolling actions between the plate cylinder and rubber blanket cylinder and between the rubber blanket cylinder and the impression cylinders, torsional vibrations occur in the elastically deformable gear train, thus leading to printing difficulties. It is also known to provide a longitudinal shaft in addition to the continuous gear train and to feed the power flowing via the longitudinal shaft into the gear train by means of one or more gears. This, although resulting in a stiffening of the gear system, increases the complexity and cost outlay in terms of mechanical construction. A solution to the vibration problem, in which a plurality of electrically regulated drives feed power into a continuous gear train, is also known. This solution, however, also necessitates a high outlay in terms of the construction of the continuous gear train and can only damp to a limited extent the torsional vibrations which occur.

German Patent Publication No. DE-4 322 744 A1 discloses an electric drive system for a printing machine. In the electric drive system each of the cylinders is equipped with a motor, and for driving the cylinders synchronously relative to one another in terms of angle of rotation, a corresponding controller. For this purpose, angular position encoders are arranged directly on the cylinders. The signals from the angular position encoders are evaluated by the controller in order to ensure synchronous running of the individual cylinders in terms of the angle of rotation. However, since the load moment fluctuates sharply during the rotation of a cylinder, correspondingly stringent requirements are placed on the quality of the drive. On the one hand, the angular position must be constant over a cylinder revolution, and furthermore, the cylinder must be capable of being driven within a predetermined rotational speed range. Finally, additional measures must also be taken, particularly in a sheet-fed offset printing machine, to ensure that the relative rotation of the cylinders, having a gripper device, beyond a predetermined amount is not possible so as to avoid damage to the cylinder surface and/or to the gripper devices.

German Patent Publication No. DE 4 202 722 A1 discloses a safety device for regulating or controlling drive units of a printing machine. In the safety device the cylinders have individual drives. In order to avoid the possibility that, in sheet-processing printing machines, the cylinders provided with individual drives will be rotated beyond a predetermined tolerance amount relative to one another, there is provided a mechanical coupling which is designed in such a way that the cylinders cannot be rotated relative to one another beyond this predetermined amount. In a fault-free regulating situation, the corresponding coupling parts have no contact with one another, however, when a fault occurs, e.g., when the above-mentioned relative rotation leading to destruction is beyond a predetermined amount the corresponding coupling parts make contact. In order to achieve the angularly synchronous running of the cylinder, however, drives of relatively complicated construction have to be used for the individual assemblies or cylinders.

German Patent Publication No. DE 4 137 979 A1 discloses a drive for a printing machine having a plurality of printing units, in which the individual printing units or printing-unit groups are mechanically uncoupled from one another and each of these groups has its own drive motor. There is provided a device for angular regulation which is designed to determine a permissible deviation in the angle of rotation of individual printing units or printing-unit groups, in such a way that the deviation is minimal in any rotary angle position which corresponds to the sheet transfer. This drive is intended to improve the register quality. Here too, relatively stringent requirements are placed on the electric drive of the individual subassemblies or cylinders, so that, the load of the cylinders or subassemblies, which is dependent on the angle of rotation, can be driven within a wide rotational speed range.

European Patent Publication No. EP 0,355,422 B1 discloses a method and a device for reducing the torque load on a printing machine system driven by an electric motor. In this system, the drive motor is controlled in such a way that changes in the load moment are kept to an approximately constant value. As a consequence, the rotational speed of a printing machine of this type is no longer a quantity constant in time, and therefore a drive principle of this kind can be transferred in only a highly complicated way to a machine in which the cylinders and/or individual subassemblies are each provided with an individual drive.

German Patent Publication No. DE 4 228 506 A1 discloses a process and a drive for a printing machine having several printing mechanisms, in which the printing mechanisms are coupled with one another over a wheel train and in which each case a drive is allocated to a printing machine unit. A first drive motor of the drive feeds a power excess into the wheel train, that is dimensioned in such a manner that a constant direction of the power flow in the wheel train is ensured. A second drive motor is utilized to compensate for this power excess.

German Patent Publication No. DE 4 234 928 A1 discloses a device and a process for the damping of mechanical vibrations in printing machines, in which at least one actuating member is allocated to the turning parts of the printing machine, which member is driven from at least one vibration receiver arranged on the printing machine, so that the setting forces of the actuating member damp the vibrations. The actuating member can be constructed as a controllable turbulent flow brake.

Japanese Patent Publication No. JP-5-318695 A discloses a drive unit for a sheet-fed printing machine, in which a main drive and an auxilliary drive are provided. These drives are coupled with one another through an adjustable torque distribution.

SUMMARY OF THE INVENTION

The object of the present invention is, therefore, to extend a multi-motor drive for a printing machine in such a way that, under predetermined requirements with respect to the synchronous running of the individually driven cylinders and/or subassemblies, the cost outlay of the drives can be appreciably lowered. Furthermore, the system of the present invention affords a high degree of safety with regard to the failure of the electric motor and/or other drive components.

According to the present invention, there is provision for each individually driven cylinder and/or subassembly of the printing machine to be provided with two drives. Through the first drive, a basic drive moment is introduced into the cylinder and/or subassembly, that is to say the drive moment that the cylinder or subassembly requires on average during one revolution. The second drive assigned to this cylinder or subassembly is designed, according to the present invention, in such a way that it has only such dynamics with regard to the remaining drive moment in order to compensate for the brief load moments occurring during one cylinder or subassembly revolution. The synchronous running of the cylinder or subassembly of a printing machine in terms of the angle of rotation is thus brought about by this second highly dynamic drive which is preferably designed as a brushless direct-current motor.

The division of the power feed via two drives in accordance with the present invention, wherein one drive has high dynamics with a lower power requirement and another drive has with respect to angular controllability, lower dynamics, but higher power, results in a marked lowering of the cost outlay. Furthermore, there can be provision for connecting the first drive having lower dynamics, feeding the basic drive moment to the cylinder or subassembly, to the cylinder or subassembly via a gear (reduction gear). This drive can advantageously be a particularly cost effective three-phase motor, especially with a calculated field model. The second highly dynamic drive which, as stated above, may preferably be designed as a brushless direct-current motor is then connected directly or via a rotationally rigid and play-free gear to the journal of the cylinder or to a journal of a cylinder of the subassembly of a printing machine.

The drive concept according to the present invention affords a number of advantages, for example, the cost benefit of implementing an individual or group drive, despite the two drives to be provided for each cylinder or subassembly, having already been explained above. A further advantage of the present invention is that, in the event of a failure of, for example, the highly dynamic drive designed for the briefly fluctuating torque situation, the particular cylinder or subassembly can be run down in a specific manner to a stop via the first drive. In this case, the remaining cylinders or subassemblies follow the time behavior of this cylinder or subassembly. The failure of a drive feeding the basic drive moment into the cylinder or subassembly can also assist in avoiding the mechanical collisions indicated at the beginning of the description. In this case, the rundown of the cylinder or subassembly takes place via the highly dynamic drive, this presenting no problem since the drives available today can be briefly overloaded.

Should both drives of a cylinder or subassembly fail, there is provision, according to the present invention, for using the position encoder signal of this cylinder or subassembly as a desired position value for all the remaining assemblies. In this case, the slowing of this cylinder or subassembly to a stop takes place, then all the remaining cylinders or subassemblies following this guiding shaft in an angularly synchronous manner. The failure of the supply voltage (main power failure) can likewise be absorbed by the drive system according to the present invention, in that, here, the converters for the drives are connected to one another, for example, via an intermediate direct-voltage circuit. The individual drives are then run down to a stop on a ramp signal, the latter being dimensioned in such a way that the full direct voltage is still available at any time as a result of the energy fed back during braking. This can be brought about in a simple way by predetermining as steep a rundown ramp as possible. If the converters of the individual drives are not connected to one another via an intermediate direct-voltage circuit, the drives reduce the incident excess braking energy via braking choppers arranged in each case in the individual intermediate circuits. In both above-identified procedures for running down the entire system in the event of the failure of the voltage supply, a sufficiently dimensioned buffer in the form of capacitors or accumulators is provided in the intermediate circuit.

In the event that both drives fail simultaneously in two different subassemblies or cylinders, there can be provision for additionally arranging mechanical collision protectors known from the prior art between the individual cylinders or subassemblies. These collision protectors ensure, in a known manner, that a relative rotation of the cylinders or subassemblies beyond a predetermined amount is avoided.

BRIEF DESCRIPTION OF THE DRAWINGS

Exemplary embodiments of the multi-motor drive in accordance with the present invention is described below with reference to the accompanying drawings in which.

DETAILED DESCRIPTION OF THE PREFERRED EMBODIMENTS

Figure 1:
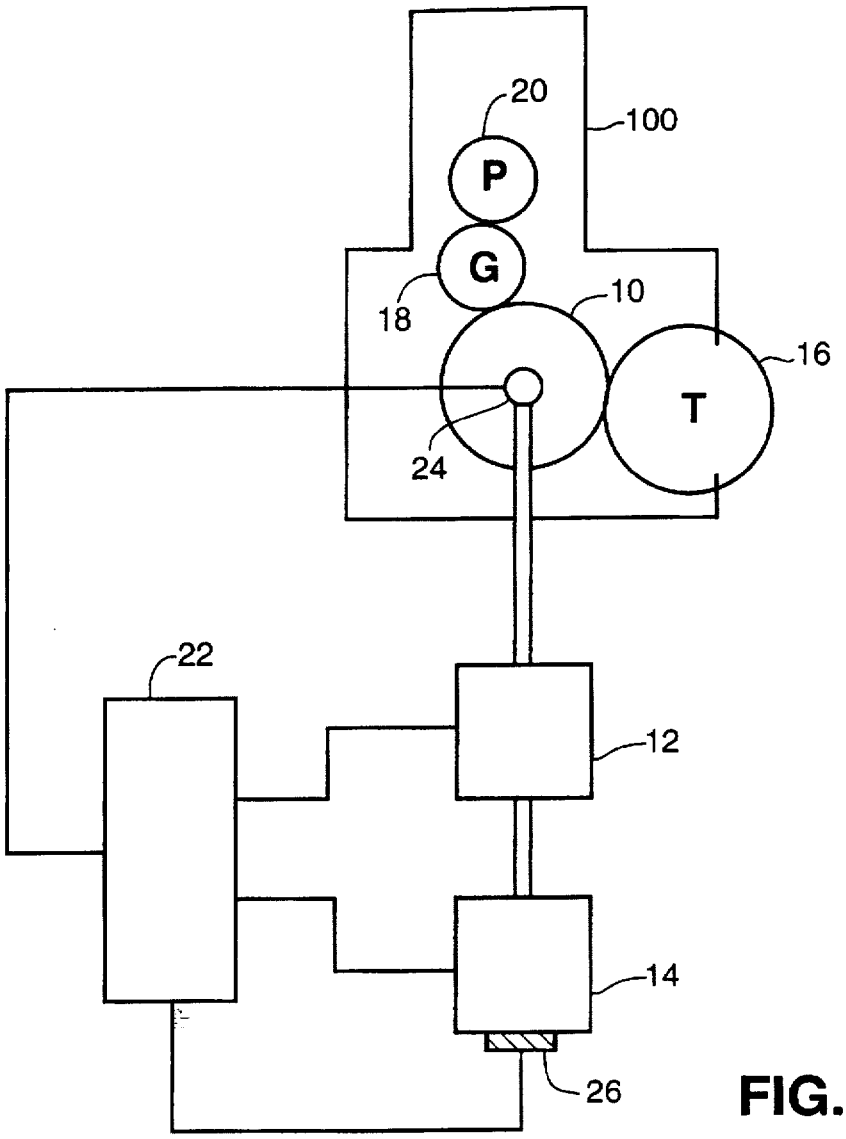
FIG. 1 is a block diagram illustration of a drive according to the present invention for a subassembly of a sheet-fed offset printing machine.

An exemplary embodiment of a multi-motor drive in accordance with the present invention is described below. Referring to FIG. 1, there is shown a cylinder 10 of a printing unit of a sheet-fed offset printing machine. The cylinder 10, which guides a sheet to be printed, is driven by two drives 12 and 14. The cylinder 10 is part of a subassembly, i.e., a single printing unit 100 of the sheet-fed offset printing machine. The printing unit 100 also comprises a transfer cylinder 16 driven by the cylinder 10, a rubber blanket cylinder 18 and a plate cylinder 20. In this case, the cylinders 10,16,18,20 are connected to one another via a continuous gear train (not illustrated). However, there is no mechanical coupling between the above-described components and the next printing unit which may have the same components.

As illustrated in FIG. 1, the cylinder 10 of the subassembly is connected or coupled to a first drive 12 and a second drive 14. The first and second drives 12,14 may be connected to the cylinder 10 by any suitable means. For example, the first and second drives 12,14 may be connected to the cylinder 10 by various gear assemblies or directly to the cylinder 10 via drive shafts. The first and second drives 12 and 14 are also operatively connected to a drive controller 22 that is connected, on the one hand, to a position encoder 24 that is connected directly to the cylinder 10 and, on the other hand, to a commutator encoder 26 mounted on the second drive 14. The position encoder 24 may comprise any suitable device for determining the angular position of the cylinder 10. For example, the position encoder 24 may comprise an optical or electromechanical angle encoder. In the exemplary embodiment, the position encoder 24 comprises an optical angle encoder. The drive controller 22 applies current to the second drive 14 according to commutator signals from the commutator encoder 26, in conjunction with the signals from the position encoder 24 on the cylinder 10. Current is likewise applied via the drive controller 22 to the first drive 12. The controller 22 may comprise any suitable means for implementing the control of the two drives 12 and 14. In the exemplary embodiment, the controller 22 comprises a microprocessor based control system and interface circuitry for communicating with the position encoder 24, the commutator 26 and the first and second drives 12,14.

The first drive 12 may comprise any suitable device for transferring torque sufficient to establish rotation of the cylinder 10, i.e., a basic drive moment. In a preferred embodiment, the first drive 12 comprises a three-phase asynchronous motor, and in a more preferred embodiment, the first drive 12 comprises a three-phase asynchronous motor with a calculated field model. The second drive 14 may comprise any suitable device for transferring torque sufficient to compensate for the brief loading moments experienced by the cylinder 10 during rotation in order to establish smooth rotation of the cylinder 10. In a preferred embodiment, the second drive 14 comprises a brushless direct-current motor. Essentially, the second drive 14 is a highly dynamic drive that supplies the torque which the first drive 12 cannot supply when the cylinder 10 experiences various loading effects.

Typically, three-phase asynchronous motors have higher power output capability and lower controllability in terms of angular positioning, while brushless direct-current motors have lower power output capability and higher controllability. Since the predominant power contributor to the cylinder 10 occurs through the first drive 12 having a lower regulating quality, the second drive 14 can be selected more economically with a more narrow torque bandwidth.

Figure 3:
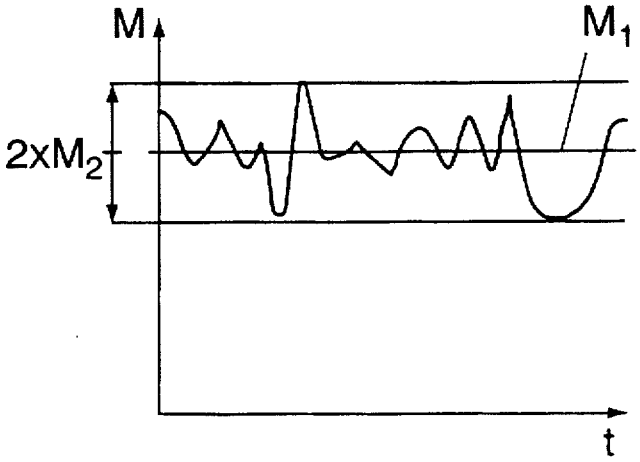
FIG. 3 is a diagrammatic illustration of a torque curve as a function of time in accordance with the present invention.

FIG. 3 graphically illustrates the total torque or moment M that is input into the cylinder 10 by the first and second drives 12 and 14. There is provision, according to the present invention, for the total moment M, to be applied during one revolution of the cylinder 10 or of the subassembly driven by the cylinder 10. The total moment M comprises an average moment M1 and a moment component M2 which is superposed on the average moment M1. The total moment M preferably has a maximum amplitude of twice M2. There is provision, according to the present invention, for feeding the average moment M1 into the cylinder 10 according to FIG. 1 by means of the first drive 12. Furthermore, the second drive 14 feeds in the brief changes in moment which occur during one revolution of the cylinder 10 and therefore of the correspondingly driven subassembly and which have a maximum amplitude of the amount M2. It results correspondingly that the second drive 14 at specific times increases the total moment M to be fed into the cylinders 10 and at other times reduces it by electrical braking, so that the angular value recorded via the position encoder 24 is brought into coincidence with a predetermined desired value. It becomes clear from the representation according to FIG. 3 that the second drive 14 has to apply a moment of bandwidth M2 relative to the average moment M1 to be applied by the first drive 12.

Figure 2:
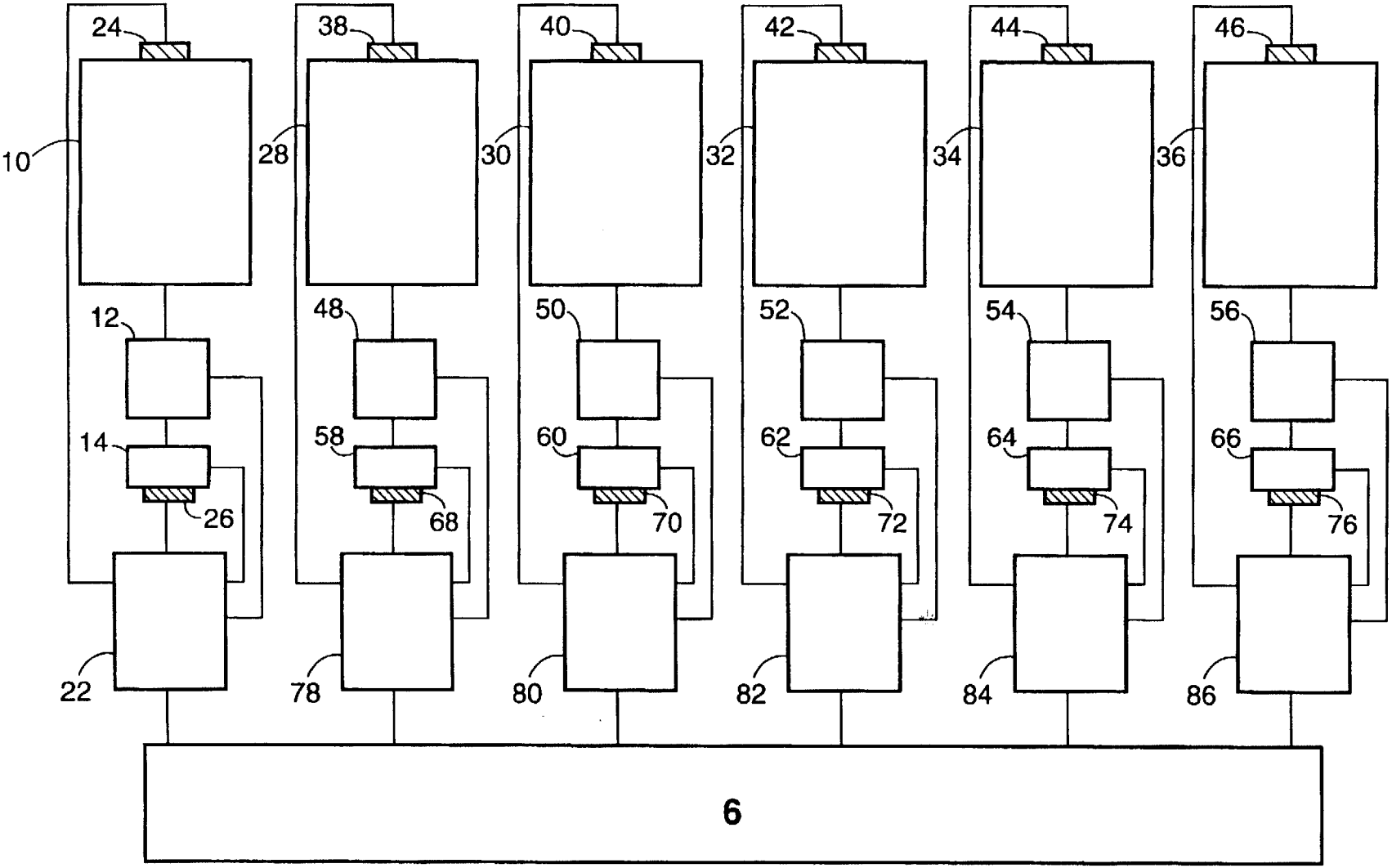
FIG. 2 is a block diagram illustration of a drive according to the present invention for a plurality of cylinders or subassemblies of a sheet-fed offset printing machine.

FIG. 2 illustrates, in block diagram format, a plurality of cylinders 10,28,30,32,34 and 36 of a sheet-fed printing machine. In this case, each of the cylinders 10,28,30,32,34 and 36 has a position encoder 24,38,40,42,44 and 46 in the form of an absolute or incremental angle encoder as described above. In this case, each of the cylinders 10,28, 30,32,34 and 36 is assigned a combination according to the present invention of a first drive 12,48,50,52,54 and 56 for feeding in the basic moment M1 and a second drive 14,58, 60,62,64 and 66 for feeding in the corresponding remaining moment. The second drives 14,58,60,62,64 and 66, designed particularly as brushless direct-current motors, are additionally also provided with commutator encoders 26,68,70,72, 74 and 76.

In this case, the first drives 12,48,50,52,54 and 56 and the second drives 14,58,60,62,64 and 66 are controlled and have current applied to them via corresponding drive controllers 22,78,80,82,84 and 86, these on the one hand feeding in respective signals from the position encoders 24,38,40,42,44 and 46, and should the second drives 14,58,60,62,64 and 66 be designed as brushless direct-current motors, additionally also the signals from the commutator encoders 26,68,70,72, 74 and 76. A master or central computer 6 is also additionally assigned to the individual drive controllers 22,78,80, 82,84 and 86. This master computer 6 carries out, in particular, those measures which are provided above in the event of failures of one or more components of the multimotor drive according to the present invention.

In the exemplary embodiment described previously, the drive of one cylinder 10,28,30,32,34 and 36 in each case was carried out, these cylinders 10,28,30,32,34 and 36 each comprising an entire subassembly comprising a plate cylinder 20, rubber blanket cylinder 18 and transfer cylinder 16. Of course, by utilizing the present invention, it can also be possible for each individual cylinder within a printing unit and therefore for all the cylinders within a printing machine to be driven by means of the combination according to the invention of a drive feeding in a basic moment M1 and additionally of a highly-dynamic drive regulating the angular position.

In accordance with another aspect of the present invention, if there is a failure in one of the two drives 12,14, for example, the second drive 14, the particular cylinder 10 or subassembly can be run down in a specific manner to a stop via the first drive 12. In this situation, the remaining cylinder or subassemblies follow the time behavior of this cylinder 10 or subassembly. If there is a failure in the first drive 12, the particular cylinder 10 or subassembly can be run down in a specific manner to a stop via the second drive 14. Although the second drive 14 is not as powerful as the first drive, running down the cylinder 10 on the second drive 14 does not present a problem because currently available drives such as the brushless direct current motor may be briefly overloaded. Should both drives 12,14 for a particular cylinder 10 or subassembly fail, the position encoder 24 may be utilized to obtain a desired position value for all the remaining assemblies. In this instance, the slowing of this cylinder or subassembly to a stop takes place and based upon its final position as indicated by the position encoder 24, the remaining cylinders in the printing machine are adjusted to this position.

The failure of the supply voltage (not illustrated) can likewise be absorbed by the drive system according to the present invention, in that, here, converters (not illustrated) for the drives 12,14 are connected to one another, for example, via an intermediate direct-voltage circuit (not illustrated). The individual drives 12,14 are then run down to a stop on a ramp signal, the latter being dimensioned in such a way that the full direct voltage is still available at any time as a result of the energy fed back during braking. This can be brought about in a simple way by predetermining as steep a rundown ramp as possible. If the converters of the individual drives are not connected to one another via an intermediate direct-voltage circuit, the drives reduce the incident excess braking energy via braking choppers arranged in each case in the individual intermediate circuits. In both above-identified procedures for running down the entire system in the event of the failure of the voltage supply, a sufficiently dimensioned buffer in the form of capacitors or accumulators is provided in the intermediate circuit.

In the event that both drives fail simultaneously in two different subassemblies or cylinders, there can be provision for additionally arranging mechanical collision protectors known from the prior art between the individual cylinders or subassemblies. These collision protectors ensure, in a known manner, that a relative rotation of the cylinders or subassemblies beyond a predetermined amount is avoided.

Although shown and described are what is believed to be the most practical and preferred embodiments, it is apparent that departures from specific methods and designs described and shown will suggest themselves to those skilled in the art and may be used without departing from the spirit and scope of the invention. The present invention is not restricted to the particular constructions described and illustrated, but should be construed to cohere with all modifications that may fall within the scope of the appended claims.

What is claimed is:

1. A multimotor drive for individual component groups of a printing machine, in which each component group includes at least one axle or cylinder, comprising a first drive unit operatively connected to a drive controller for providing an average drive moment required to drive the component group; a second highly dynamic drive unit operatively connected to the drive controller for providing a residual drive moment required to compensate for a load moment on the component group; a position sensor for sensing the position of the component group and to cooperate with the drive controller to adjust the residual drive moment provided by the second drive unit to angle-synchronously regulate the position of the component groups relative to one another.

2. The multimotor drive according to claim 1, wherein the first drive unit is an asynchronous motor.

3. The multimotor drive according to claim 1, wherein the second drive unit is a brushless direct-current motor.

4. The multimotor drive according to claim 1, wherein the drive controllers of the first drive unit and the second drive unit are connected to one another with a guide computer.

5. A multimotor drive for a printing machine in which for each component group there is assigned: at least one drive unit storing the required torque and driving individual axles or cylinders in the component group, and position detectors are provided for the angle-synchronous regulating; to each component group there is assigned in each case a first drive for providing the torque required on the average; to each component group there is assigned a further highly dynamic drive unit over which the residual moment is provided; and that the position detector cooperates with the further drive.

6. The multimotor drive according to claim 5, wherein the first drive is constructed as an asynchronous motor.

7. The multimotor drive according to claim 5, wherein the further drive is constructed as a brushless direct-current motor.

8. Multimotor drive according to claim 5, wherein the drive controls allocated to the first drive as well as the further drive are connected with a guide computer.

* * * * *